US008663404B2

(12) United States Patent
Yang et al.

(10) Patent No.: US 8,663,404 B2
(45) **Date of Patent: *Mar. 4, 2014**

(54) HEAT TREATMENT METHOD AND COMPONENTS TREATED ACCORDING TO THE METHOD

(75) Inventors: Ling Yang, Clifton Park, NY (US); Robin Carl Schwant, Pattersonville, NY (US)

(73) Assignee: General Electric Company, Schenectady, NY (US)

( * ) Notice: Subject to any disclaimer, the term of this patent is extended or adjusted under 35 U.S.C. 154(b) by 191 days.

This patent is subject to a terminal disclaimer.

(21) Appl. No.: 11/620,897

(22) Filed: Jan. 8, 2007

(65) Prior Publication Data

US 2008/0163963 A1 Jul. 10, 2008

(51) Int. Cl.
*C22F 1/10* (2006.01)
*C21D 6/02* (2006.01)

(52) U.S. Cl.
USPC ..... 148/675; 148/674; 148/579

(58) Field of Classification Search
USPC ..... 148/675, 677, 674, 579
See application file for complete search history.

(56) References Cited

U.S. PATENT DOCUMENTS

| | | | | |
|---|---|---|---|---|
| 2,327,839 | A | 8/1943 | Zschokke | |
| 2,834,698 | A * | 5/1958 | Newport | 148/538 |
| 3,220,829 | A | 11/1965 | Stewart et al. | |
| 3,420,660 | A | 1/1969 | Kawahata et al. | |
| 3,705,827 | A | 12/1972 | Muzyka | |
| 3,826,649 | A | 7/1974 | Soderberg et al. | |
| 3,871,928 | A | 3/1975 | Smith, Jr. et al. | |
| 4,608,094 | A | 8/1986 | Miller et al. | |
| 4,788,036 | A | 11/1988 | Eiselstein et al. | |
| 4,985,201 | A | 1/1991 | Chang et al. | |
| 5,019,334 | A | 5/1991 | Jackson | |
| 5,080,734 | A | 1/1992 | Krueger et al. | |
| 5,100,050 | A | 3/1992 | Krueger et al. | |
| 5,161,950 | A | 11/1992 | Krueger et al. | |
| 5,374,323 | A | 12/1994 | Kuhlman et al. | |
| 5,415,712 | A | 5/1995 | Thamboo | |
| 5,820,817 | A | 10/1998 | Angeliu et al. | |
| 5,846,353 | A | 12/1998 | Nazmy et al. | |
| 5,863,494 | A | 1/1999 | Nazmy et al. | |
| 6,128,820 | A | 10/2000 | Nolan et al. | |
| 6,146,478 | A * | 11/2000 | Balbach et al. | 148/707 |
| 6,217,286 | B1 | 4/2001 | Huang et al. | |
| 6,315,846 | B1 | 11/2001 | Hibner et al. | |
| 6,447,624 | B2 | 9/2002 | Nonomura et al. | |
| 6,454,531 | B1 | 9/2002 | Crawmer | |
| 6,494,683 | B1 | 12/2002 | Nolan et al. | |
| 6,562,157 | B2 * | 5/2003 | Nonomura et al. | 148/677 |
| 7,033,448 | B2 | 4/2006 | Groh et al. | |

OTHER PUBLICATIONS

Superalloy. Dictionary.com. Dictionary.com Unabridged (v 1.1). Random House, Inc. http://dictionary.reference.com/browse/superalloy (accessed: Jul. 10, 2008).*

Karl A. Heck, "The Time-Temperature-Transformation Behavior of Alloy 706", The Minerals, Metals & Materials Society, 1994, pp. 393-404.

Sarwan Mannan and Frank Veltry, "Time-Temperature-Transformation Diagram of Alloy 725", The Minerals, Metals & Materials Society, 2001, pp. 345-350.

ASM International, Materials Park, Ohio, ASM Specialty Handbook: Nickel, Cobalt, and Their Alloys, "Metallography and Microstructures of Heat Resistant Alloys", Dec. 2000, pp. 302-304.

* cited by examiner

*Primary Examiner* — Jessee Roe
(74) *Attorney, Agent, or Firm* — Cantor Colburn LLP

(57) ABSTRACT

Disclosed herein is a method of treating a component comprising solution treating the component for a period of about 4 to about 10 hours at a temperature of about 1750 to about 1850°F.; cooling the component to a temperature of about 1580 to about 1650°F. at an average rate of 1°F./min to about 25°F./min; stabilizing the component at about 1580 to about 1650°F. for a period of about 1 to about 10 hours; cooling the component to room temperature; precipitation aging the component at a first precipitation aging temperature of about 1275 to about 1375°F. for about 3 to about 15 hours; cooling the component at an average rate of 50 to about 150°F./hour to a second precipitation aging temperature of about 1100 to about 1200°F. for a time period of about 2 to about 15 hours; and cooling the component.

7 Claims, 1 Drawing Sheet

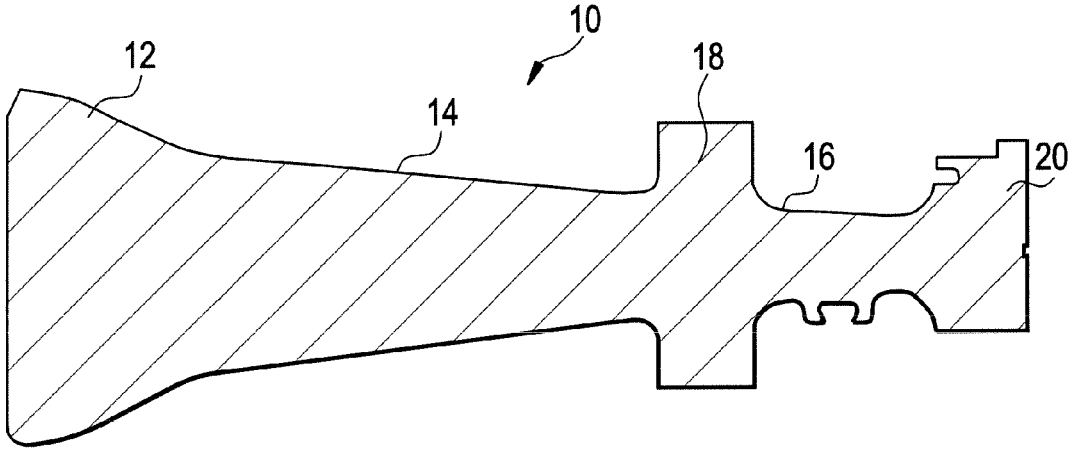
10
12
14
18
16
20

HEAT TREATMENT METHOD AND COMPONENTS TREATED ACCORDING TO THE METHOD

BACKGROUND OF THE INVENTION

This disclosure is related to a heat treatment method and to components heat treated according to the method.

Superalloys are metallic alloys for elevated temperature service, generally based on group VIIA elements of the periodic table, and are used for elevated temperature applications where resistance to deformation and stability are desired. The common superalloys are based on nickel, cobalt or iron. Nickel-iron base superalloys such as, for example Alloy 706 are generally employed as materials of construction in gas turbine engine components such as rotor discs (hereinafter rotors) and spacers.

As a result of the demand for improved performance and efficiency, the components of modern gas turbine engines operate near the limit of their properties with respect to temperature, stress, and oxidation/corrosion. Due to these aggressive operating environments, the superalloys from which the components are made generally possess a combination of exceptional properties including high strength capabilities at elevated temperatures greater than or equal to about 700° F. In particular, nickel-iron base superalloy articles suitable for components such as turbine rotors and discs must possess superior low cycle fatigue strength because of repeated cycling between full engine power and idle. This repeated cycling induces thermomechanical stresses within the engine. It is generally desirable for such superalloy articles to possess superior low cycle fatigue strength in order to withstand such conditions. In current gas turbine rotor designs, life of the rotor can be limited by the low cycle fatigue capability of the material.

There are two known heat treatment processes that are prescribed by International Nickel Company (INCO), the inventor of the Alloy 706. The two known heat treatment processes are heat treatment A and heat treatment B respectively. Heat treatment A is recommended for optimum creep and high temperature rupture properties, while heat treatment B is recommended for applications requiring high tensile strength.

Heat treatment A comprises a solution treatment at 1700 to 1850° F. for a time commensurate with the section size, followed by a first air cooling. The first air cooling is followed by a stabilization treatment at 1550° F. for three hours, followed by a second air cooling. Following the second air cooling is a precipitation treatment at 1325° F. for 8 hours. The object is then cooled in a furnace at an average rate of 100° F./hr to 1150° F. where it is held for 8 hours. The cooling in the furnace is followed by a third air cooling.

Heat treatment B comprises a solution treatment at 1700 to 1850° F. for a time commensurate with the section size followed by a first air cooling. The first air cooling is followed by a precipitation treatment at 1350° F. for 8 hours followed by cooling in a furnace at an average rate of 100° F./hr to a temperature of 1150° F. where it is held for one hour. This is followed by a second air cooling.

While heat treatment A is recommended for optimum creep and high temperature rupture properties and heat treatment B is recommended for applications requiring a high tensile strength there are no treatments that improve the low cycle fatigue of components manufactured from superalloys. It is therefore desirable to provide a heat treatment for turbine rotors manufactured from superalloys that facilitate an improvement in the low cycle fatigue capability of the rotor.

BRIEF DESCRIPTION OF THE INVENTION

Disclosed herein is a method of treating a component comprising solution treating the component for a period of about 4 to about 10 hours at a temperature of about 1750 to about 1850° F.; cooling the component to a temperature of about 1580 to about 1650° F. at an average rate of 1° F./min to about 25° F./min; stabilizing the component at about 1580 to about 1650° F. for a period of about 1 to about 10 hours; cooling the component to room temperature; precipitation aging the component at a first precipitation aging temperature of about 1275 to about 1375° F. for about 3 to about 15 hours; cooling the component at an average rate of 50 to about 150° F./hour to a second precipitation aging temperature of about 1100 to about 1200° F. for a time period of about 2 to about 15 hours; and cooling the component.

Disclosed herein is a method of treating a component comprising solution treating the component for a period of about 4 to about 10 hours at a temperature of about 1750 to about 1850° F.; quenching the rotor cooling the component to room temperature in a liquid media; stabilizing the component at about 1580 to about 1650° F. for a period of from about 1 to about 10 hours; cooling the component to room temperature; precipitation aging the component by heating the component to a first precipitation aging temperature of about 1275 to about 1375° F. for about 3 to about 15 hours; cooling the component at an average rate of 50 to about 150° F./hour to a second precipitation aging temperature of about 1100 to about 1200° F. for a time period of about 2 to about 15 hours; and cooling the component.

BRIEF DESCRIPTION OF THE DRAWINGS

The Figure is a cross-section of a typical turbine rotor disk component of the type that is amenable to the heat treatment described herein.

DETAILED DESCRIPTION OF THE INVENTION

Disclosed herein is a method for heat treatment of a component manufactured from a superalloy that improves the low cycle fatigue capability of the component. The method comprises several heating and cooling steps one of which comprises heating the component to a stabilization temperature of about 1580 to about 1650° F. for a period of about 1 to about 10 hours. The method advantageously improves the low fatigue capability of the component by up to 30% over comparative components that have not been subjected to the heat treatment. The improvement in the low cycle fatigue is brought about because of an improvement in the ductility of the superalloy.

As noted above, superalloys are metallic alloys for elevated temperature service that comprise group VIIA elements. Superalloys based on nickel, cobalt or iron may be subjected to the method for heat treatment disclosed herein. Examples of such superalloys are HASTALLOY®, INCONEL®, HAYNES® alloys, MP98T®, TMS alloy, CMSX® single crystal alloys or combination comprising at least one of the foregoing alloys. An exemplary alloy that can be subjected to the heat treatment disclosed herein is Alloy 706.

Alloy 706 generally comprises about 37 to about 45 weight percent (wt %) nickel, about 12 to about 18 wt % chromium, up to about 10 (i.e., 0 to about 10) wt % molybdenum. The Alloy 706 can also comprise manganese, tungsten, niobium, titanium, and aluminum in an amount of about 4 to about 10 wt %, with the balance being iron.

In an exemplary embodiment, the method of heat treatment may be employed to increase the low cycle fatigue of a turbine rotor. With reference to the Figure, a disk component from a turbine rotor 10 is shown in cross-section, and illustrates the complex shape that requires specialized heat treatment. The shape varies from a relatively thick radially inner portion 12 that is radially adjacent the rotor bore, through an intermediate portion 14 of decreasing thickness, to a radially outer portion 16 that is generally thinner than portion 12 but with variations indicated at 18 and 20.

In arriving at the method of heat treatment, the above described geometry of the Figure is taken into account, recognizing that the outer portion 16 and surfaces thereof remain at stabilization temperature for a different period than the inner portion 12 near the bore (not shown). The disk may be rapidly cooled from the stabilization temperature before the disk has a chance to achieve a uniform temperature throughout. In other words, the outer portion experiences this stabilization temperature for a longer period than the inner portion because of cross-sectional area differences and slow conduction of heat through the disk during heating to the stabilization temperature.

The method of heat treatment advantageously comprises solution treating the turbine rotor for a time period of about 4 to about 10 hours at a temperature of about 1750 to about 1850° F. Solution treating of the turbine rotor is generally conducted by holding the rotor at an elevated temperature for a sufficient length of time to allow a desired constituent of the Alloy 706 to enter into solid solution, followed by rapid cooling to hold the constituent in solution. In one embodiment, the time period for the solution treating can be an amount of about 5 to about 9 hours. An exemplary time period for the solution treating is about 8 hours. In another embodiment, the temperature for the solution treating is about 1775 to about 1825° F. An exemplary temperature for the solution treating is about 1775° F.

Following the solution treatment step, the turbine rotor is subjected to a stabilization step at a stabilization temperature of about 1580 to about 1650° F. The temperature of the turbine rotor may be lowered from the solution treatment temperature to the stabilization temperature by one of the following two ways.

In one embodiment, in a first method of arriving at the stabilization temperature, the turbine rotor is air cooled from the solution treatment temperature at an average rate of about 1 degree F. per minute (° F./min) to about 25° F./min to the stabilization temperature.

In another embodiment, in a second method of arriving at the stabilization temperature, the turbine rotor is quenched in liquid media to room temperature. Exemplary liquid media are oil or water or both. Following the cooling, the turbine rotor is heated to the stabilization temperature and held at the stabilization temperature for a period of time as indicated below. The average ramp rate of the furnace from room temperature to the stabilization temperature is about 1° F./min to 25° F./min.

As noted above, the turbine rotor is then subjected to stabilization step wherein the turbine rotor is annealed at a stabilization temperature of about 1580 to about 1650° F. for a period of about 1 to about 10 hours. In one embodiment, the stabilization temperature is about 1590 to about 1635° F. An exemplary temperature for the stabilization is about 1600° F. In one embodiment, a suitable time period for stabilization is about 2 to about 8 hours. An exemplary time period is about 3 hours.

The turbine rotor is then cooled to room temperature. Room temperature is about 30 to about 100° F. The average rate of cooling from the elevated temperature (i.e., about 1580 to about 1650° F.) to room temperature is about 10° F./min. This cooling is continuously conducted in a furnace in a controlled manner.

The rotor is precipitation aged in two steps. In a first precipitation aging step, the turbine rotor is heated to a temperature of about 1275 to about 1375° F. for about 3 to about 15 hours. In one embodiment, the precipitation aging is conducted at a temperature of about 1290 to about 1375° F. A suitable time period for the precipitation aging is about 5 to about 9 hours. An exemplary precipitation aging can be conducted at 1325° F. for about 8 hours. Precipitation aging, also called "age hardening", is a heat treatment technique used to strengthen malleable materials. It relies on changes in solid solubility with temperature to produce fine particles of a secondary phase, which impede the movement of dislocations, or defects in a crystal's lattice. Since dislocations are often the dominant carriers of plasticity (deformations of a material under stress), this serves to harden the material.

Following the first step of precipitation aging, the turbine rotor is subjected to a second step of precipitation aging. During this second precipitation aging step, the rotor is cooled in a furnace at an average rate of about 50 to about 150° F./hour to a temperature of about 1100 to about 1200° F. An exemplary average cooling rate is 100° F./hour. An exemplary temperature is about 1150° F. In one embodiment, the turbine rotor is held at a temperature of about 1100 to about 1200° F. for about 2 to about 15 hours. In an exemplary embodiment, the turbine rotor is held at about 1150° F. for a time period of about 8 hours. The turbine rotor is then air cooled to room temperature.

The following examples, which are meant to be exemplary, not limiting, illustrate the method of heat treatment of a turbine rotor comprising an Alloy 706 composition as described herein.

EXAMPLE

This example was conducted to demonstrate the effect of the stabilization temperature on the time to failure of a section of a turbine rotor. A portion of the bolt-hole region (hereinafter the "component") of the turbine rotor was subjected to the following heat treatment method. The component was solution heat treated to a temperature of 1775° F. for a time period of 4 hours. Following this, the component was cooled to a temperature of 1600° F. and stabilized for a time period of either 1, 3 or 5 hours. The average cooling rate from the solution heat treatment temperature of 1775° F. to the stabilization temperature of 1600° F. was either 5° F./min or 25° F./min.

Following the stabilization, the component was cooled to room temperature. The component was then precipitation aged at 1325° F. for about 8 hours followed by cooling the component to 1150° F. and retaining the component at 1150° F. for about 8 hours. The sample was then air cooled to room temperature. The test protocol along with the test data is shown in the Table 1.

All sample were tested to determine the low cycle fatigue of the component. Low cycle fatigue tests were performed at 600° F. The components were subjected to a cyclical perturbation at a strain of 0.9%, wherein the perturbation comprised a triangular waveform with A=1. A is the ratio of alternating stress to mean stress. The results for the test are shown in Table 1 below.

TABLE 1

| Sample # | Cooling Rate (° F./min) | Stabilization Time (minutes) | Nf @ 600° F., 0.9% | LCF Improvement |
|---|---|---|---|---|
| 1 | 5 | 60 | 1764 | 12.8% |
| 2 | 25 | 60 | 1869 | 19.5% |
| 3 | 5 | 180 | 2003 | 28.1% |
| 4 | 25 | 180 | 1967 | 25.8% |
| 5 | 5 | 300 | 1603 | 2.5% |
| 6 | 25 | 300 | 1778 | 13.7% |
| Baseline | | | 1564 | |

From the Table 1 it may be seen that by maintaining the component at the stabilization temperature of 1600° F. for a time period of 1 to 5 hours, the low cycle fatigue life is increased. The comparative sample titled "Baseline" in the Table 1 shows a cycle to failure of only 1564 cycles, whereas the samples heat treated at 1600° F. display a low cycle fatigue life of about 1603 to about 2003 cycles.

Thus, by heat treating articles such as turbine rotors that comprise Alloy 706 according to the method prescribed above, it is possible to increase the low cycle failure life by an amount of greater than or equal to about 10%, specifically greater than or equal to about 12%, more specifically greater. than or equal to about 20%, even more specifically greater than or equal to about 25%.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of treating a superalloy component comprising:

solution treating the component for a period of about 4 to about 10 hours at a solution treating temperature of about 1750 to about 1850°F.;

cooling the component from the solution treating temperature to a stabilizing temperature of 1580 to about 1650°F. at an average rate of about 1°F/min to about 25°F/min;

stabilizing the component at the stabilizing temperature of 1580 to about 1650°F. for a period of about 1 to about 3 hours;

cooling the component from the stabilizing temperature to room temperature;

precipitation aging the component at a first precipitation aging temperature of about 1275 to about 1375°F. for about 3 to about 15 hours;

cooling the component at an average rate of 50 to about 150°F/hour to a second precipitation aging temperature of about 1100 to about 1200°F. for a time period of about 2 to about 15 hours; and cooling the component from the second precipitation aging temperature to room temperature.

2. The method of claim 1, wherein the component is solution treated to a temperature of about 1775°F.

3. The method of claim 2, wherein the component is solution treated for about 4 hours.

4. The method of claim 1, wherein the stabilizing the component is conducted at a temperature of 1600°F.

5. The method of claim 1, wherein the first precipitation aging temperature is about 1325°F.

6. The method of claim 5, wherein the component is maintained at the first precipitation aging temperature for about 5 to about 9 hours.

7. The method of claim 1, wherein the component is a turbine rotor or a turbine rotor component.

* * * * *